US009302898B2

(12) United States Patent
Robinson

(10) Patent No.: US 9,302,898 B2
(45) Date of Patent: Apr. 5, 2016

(54) UNITARY INTEGRAL FUSED STOUT TAP AND COLD BLOCK

(71) Applicant: Jon Joseph Robinson, Lakewood, CO (US)

(72) Inventor: Jon Joseph Robinson, Lakewood, CO (US)

( * ) Notice: Subject to any disclaimer, the term of this patent is extended or adjusted under 35 U.S.C. 154(b) by 0 days.

(21) Appl. No.: 14/274,655

(22) Filed: May 9, 2014

(65) Prior Publication Data

US 2014/0246459 A1 Sep. 4, 2014

Related U.S. Application Data

(63) Continuation-in-part of application No. 13/369,219, filed on Feb. 8, 2012, now Pat. No. 8,757,445, which is a continuation-in-part of application No. 12/321,341, filed on Jan. 17, 2009, now abandoned.

(51) Int. Cl.
*B67D 1/08* (2006.01)

(52) U.S. Cl.
CPC ..... *B67D 1/0867* (2013.01); *B67D 1/0862* (2013.01); *Y10T 29/49988* (2015.01)

(58) Field of Classification Search
CPC ..... B67D 1/0021; B67D 1/0859
USPC ..... 222/146.1, 146.6, 129, 144, 129.1; 62/394, 396
See application file for complete search history.

(56) References Cited

U.S. PATENT DOCUMENTS

| | | | | |
|---|---|---|---|---|
| 1,969,643 | A * | 8/1934 | Fuchs et al. | 62/168 |
| 2,259,852 | A | 10/1941 | Hall | |
| 2,286,205 | A | 6/1942 | Grubb | |
| 2,450,315 | A | 9/1948 | Vetrano | |
| 2,612,357 | A * | 9/1952 | Parks | 62/390 |
| 2,771,752 | A * | 11/1956 | Tennant | 62/224 |
| 3,556,347 | A * | 1/1971 | Segal et al. | 222/132 |
| 3,730,210 | A * | 5/1973 | Heyne | 137/329.1 |
| 4,094,445 | A | 6/1978 | Bevan | |
| 5,484,015 | A * | 1/1996 | Kyees | 165/168 |
| 5,537,825 | A | 7/1996 | Ward | |
| 5,564,602 | A * | 10/1996 | Cleland et al. | 222/146.6 |
| 5,694,787 | A | 12/1997 | Cleleand et al. | |
| 5,873,259 | A | 2/1999 | Spillman | |
| 6,237,652 | B1 | 5/2001 | Nelson | |
| 6,360,556 | B1 | 3/2002 | Gagliano | |
| 7,013,668 | B2 * | 3/2006 | Kyees | 62/390 |
| 7,140,514 | B2 | 11/2006 | Van Der Klaauw et al. | |
| 7,188,751 | B2 | 3/2007 | Van Der Klaauw et al. | |
| 7,272,951 | B2 | 9/2007 | Kyees | |
| 8,079,230 | B2 | 12/2011 | Frank et al. | |
| 2006/0075761 | A1 * | 4/2006 | Kitchens et al. | 62/3.64 |

* cited by examiner

*Primary Examiner* — Paul R Durand
*Assistant Examiner* — Donnell Long
(74) *Attorney, Agent, or Firm* — Craig Barber; Barber Legal

(57) ABSTRACT

A beverage tower having a solid cold block with glycol recirculation, the tap/valve is built into the cold block and is integral and fused thereto, so as to keep the entire beverage tap cold and maintain the beverages in a sanitary condition meeting health codes. The coolant lines within the cold block pass entirely around the tap in the cold block in serpentine fashion or in a coolant chamber, resulting in a tap which remains cooled effectively, while the cold block provides thermal inertia to the system. In particular, the entire valve stem and parts of the tap containing it are integral with and surrounded by the cold block. A method of construction is provided for an improved unitary integrated fused tapped cold block.

7 Claims, 12 Drawing Sheets

Figure 12
Prior Art
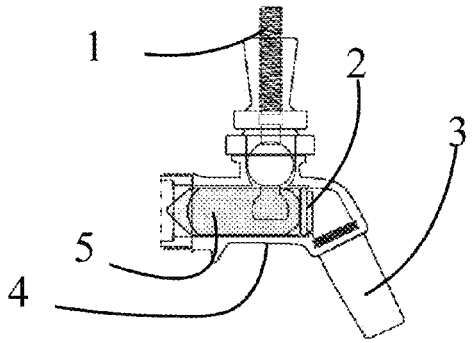
Figure 13
Prior Art
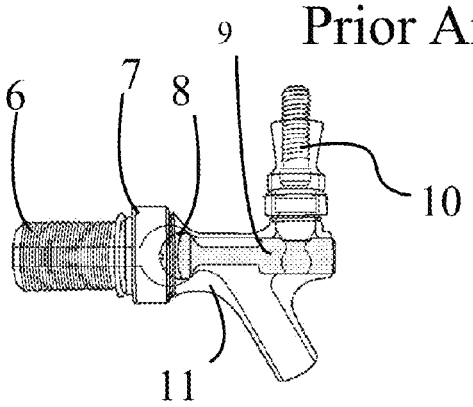
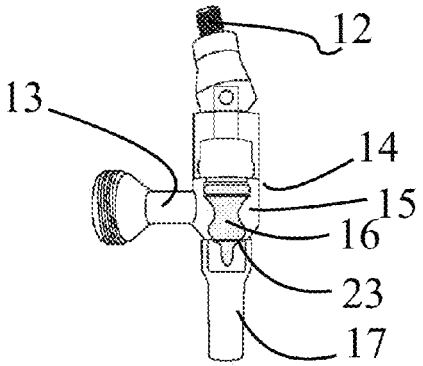
Figure 14
Prior Art
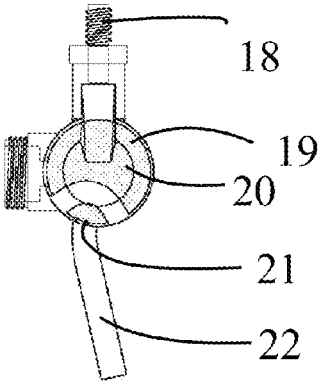
Figure 15
Prior Art

| REF. NO. | STEP |
|---|---|
| 3000 | Provide stout tap |
| 3002 | Provide beverage conduit |
| 3004 | Attach beverage conduit to stout tap (silver solder) |
| 3006 | Provide mold |
| 3008 | Position stout tap and beverage conduit in mold, stout tap projecting from top (if non-electric) and bottom (nozzle), conduit ends projecting from mold |
| 3010 | Position coolant line (contact or surround valve body of stout tap) |
| 3012 | Cast molten metal into mold, leave no voids |
| 3014 | Cool molten metal, fusing cold block with conduits and tap |
| 3016 | Attach a tap nozzle to stout tap bottom end |
| 3018 | Attach a tap handle to stout tap top (if non-electric) |
| 3020 | Remove from mold |
| 3022 | Clean, trim |
| 3024 | Apply adhesive insulation such as insulation gum |

Fig. 20

UNITARY INTEGRAL FUSED STOUT TAP AND COLD BLOCK

CROSS-REFERENCE TO RELATED APPLICATIONS

This invention claims the priority and benefit of co-pending U.S. patent application Ser. No. 13/369,219, filed Feb. 8, 2012 in the name of the same inventor, Jon Joseph Robinson, and entitled "COLD BLOCK WITH EMBEDDED CHAMBERED BEVERAGE TAP" for which the entire application including disclosures are incorporated herein by this reference, and furthermore claims thereby the priority and benefit of U.S. patent application Ser. No. 12/321,341 filed Jan. 17, 2009 in the name of the same inventor, Jon Joseph Robinson, and entitled "COLD BLOCK WITH INTEGRAL BEER TAP", for which the entire application also including disclosures are incorporated herein by this reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

FIELD OF THE INVENTION

This invention relates generally to beverage taps.

STATEMENT REGARDING FEDERALLY FUNDED RESEARCH

This invention was not made under contract with an agency of the U.S. Government, nor by any agency of the U.S. Government.

BACKGROUND OF THE INVENTION

In beverage dispensing technology, it is imperative for both sanitary and regulatory reasons to maintain consistent, stable and low temperatures in many products while they are being dispensed. Cooling has been shown to slow bacterial growth, which is important for beverages which must be kept cold at all times so as to maintain sanitary conditions and assist maintenance of sanitary conditions for the beverage, in keeping with food safety codes. The importance of this can be understood in the following terms: if a product cannot be maintained at the proper temperature in conformity with regulations on health and safety, then the product simply cannot be dispensed. Thus the entire shape of industries such as drinking, food management and entertainment can be altered by the practical limits of temperature control. Different products have different regulatory standards, for example, NSF 18 is applicable to general beverage technology, while NSF 20 is applicable to bulk milk dispensing.

A typical prior art beverage dispensing tower is shown in FIGS. 10A, 10B and 10C, a tap type which might be manufactured by Perlick or any other manufacturer for many years. (For example, see U.S. Pat. No. 5,694,787 issued Dec. 9, 1987 to Cleleand et al.) The tower 102 has a top 104 and a tap 106 (106, 106A, 106B). Tap 106 projects out from the front of the tower top 104, on shank 116. A shank assembly 116 is embedded inside of a cold block 120. Tap handle 114 includes an internal faucet lever that is attached to an internal valve stem having at least two positions (forward/open and backward/closed), and thus allows beverages to be dispensed from orifice 112, due to the presence of the internal valve. Note that the valve usually (in most designs) cuts off flow at 108, which is the rear of the faucet, and the location of the valve seat, and so some of the beverage which is held within the system is inside the tap 106 and will essentially drain out after the tap is closed. This is important as there is a "cold block" 120 within the tower (102/104). The cold block keeps the beverage within the tower cold as the beverage stops at the valve seat at the intersection of 110 and 120. (The tap 106, however, essentially only receives a minimum of cooling by conduction from cold block 120 through the shank assembly 116.)

Thus standard designs do not hold beverage within the faucet body 106: there is beverage at 108 and the point of dispense is functionally at 108. To reiterate, the significant factor here is the ability to meet regulatory standards: business and other considerations must conform to this overriding issue.

In other designs such as the Perlick "sanitary faucet" 106A or stout faucets such as 106B, the valve is reversed and beverage remains within the faucet, attempting to rely upon the conduction from the cold block to keep the external faucet cold.

The prior art "cold block" as used for many decades is a conductive block with channels running through it. The channels carry glycol coolant, which is kept separated from one or more product channels carrying the beverage. The channels of glycol can absorb large amounts of heat and carry it away to a heat exchanger such as a radiator located at a remote location. The aluminum or Kirksite composite (a zinc alloy typically having a modest amount of aluminum and copper) cold block has excellent heat transmission properties, heat rejected by the beverage as it passes through the cold block can easily enter the cold block and then be rejected into the glycol and away. If the valve location 108 is situated projecting near the cold block 120 (as some products by Perlick and others have had for 50 years or more) then the traditional arrangement keeps the beverage cold right to the point of dispense at valve part 108. The glycol channels in the prior art arrangements may run throughout cold block 120 in any of a wide range of ways, for example, the glycol channels may run right to the point of dispense at valve part 110 (except of course Perlick sanitary faucets, stout faucets and the like).

Other systems teach using coolant lines to cool the feed lines running up to the valves but with no true cold block (as in soft drink fountain systems).

Various types of systems have been proposed.

U.S. Pat. Nos. 7,188,751 and 7,140,514 issued Mar. 13, 2008 and Nov. 28, 2006 to Van Der Klaauw et al, U.S. Pat. No. 6,360,556 issued Mar. 26, 2002 to Gagliano, U.S. Pat. No. 6,237,652 issued May 29, 2001 to Nelson, U.S. Pat. No. 5,537,825 issued Jul. 23, 1996 to Ward, U.S. Pat. No. 4,094,445 issued Jun. 13, 1978 to Bevan, U.S. Pat. No. 2,450,315 issued Sep. 29, 1948 to Vetrano, U.S. Pat. No. 2,286,205 issued Jun. 16, 1942 issued to Grubb, U.S. Pat. No. 2,259,852 issued Oct. 21, 1941 to Hall show some typical examples of the prior art in the field.

U.S. Pat. No. 7,272,951 issued Sep. 25, 2007 to Kyees teaches that the cooling lines in a cold block may pass about the tap shank and/or socket fittings (not the tap heads themselves). The tap heads still project from the tower, as may be seen in FIG. 14b of that reference.

Note that U.S. Pat. No. 5,694,787 issued Dec. 9, 1987 to Cleleand et al teaches a beer chilling tower of a type very similar to that previously discussed in reference to Prior Art FIGS. 10*a*, 10*b*, 10*c* of the present application. This tap is a pre-mix tap, that is, one in which any beverage mixing is carried out prior to the tap body itself. For comparison, in FIG. 5 of the Cleleand references it may be seen that only a rear end of the tap ("threaded nipple or stem", Cleleand, col. 7, line 17) is embedded within the tower, and the Patent Office has previously stated in the parent application that the Cleleand reference is only partially embedded. In particular, the actual valve body having the valve stem therein projects from the cold block. This significant structural difference is the reason that the Cleleand reference cannot be used for dispensing dairy products or the like.

It may also be seen that the tap is not fused or integrated with the cold block: the threaded nature of parts V and P ("shank") of that reference allow the removal of the entire tap.

Finally, it will be appreciated that the Cleleand reference teaches a tap on the order of either a "Perlick-style" tap or else a general-style tap, ("general" is not a make or tradename, just an indication that the diagrammed tap is general in nature) but does not teach a Stout tap or the like.

Testing by the applicant of systems similar to the general-style beer tap system (such as PRIOR ART FIG. 13, that is, pre-mix beer taps with a cold block extending only to the the stem of the valve but not encircling the actual valve itself revealed that such taps could NOT pass the NSF 20 tests carried out by the National Sanitation Facility and thus could not be used for dairy products. The reason for this was that the milk and beverage held inside of the valve stem portion of the tap (the majority of the tap which projects out from the cold block but carries within it some beverage) would warm quite quickly, even reaching temperatures exceeding 70 degrees F. despite the fact that the NSF 20 test requires a four hour period of maintaining temperatures below 41 degrees F.

In addition, the applicant has found that it is physically impossible to embed an entire faucet body of the "Perlick" or general type into a horizontal cold block without blocking the operation of the valve, the tap, the faucet or other parts. Not only would it not be serviceable, it would not even be possible to get beer to flow out if the entire tap were embedded.

Another reference, but of less interest, is U.S. Pat. No. 5,873,259 issued Feb. 23, 1999 to Spillman, which deals with "post-mix" style taps in which the mixing is carried out at a soda cone or similar point. The Spillman reference teaches two items, one of which is hand-held technology (a gun shaped unit) which is presumably impossible to combine with a large cold block.

However, FIG. 7 of the Spillman reference teaches a hollow tower of the soda fountain type seen in fast food restaurants, made of bent sheet metal. This hollow tower has within it a series of coolant lines which are wrapped around the beverage lines and then for a short run which does not include the solenoids, it has a cold block.

It is also worth noting that the electrical solenoid valves of the soda fountain are disposed lower down in the hollow tower, far below the actual cold block, that is the solenoid valves of the Spillman reference are also not completely encircled by the cold block.

This last structural difference is important due to the siphoning effect in which the beverage within the upper part of the hollow soda tower returns down the lines to the solenoid and thus leaves the cold block. In effect, the cold block cools empty lines and the beverage which is below the cold block is insulated by nothing but thin sheet metal of the sides of the hollow tower.

Thus, it is not generally known to actually place the traditional stout tap into the cold block itself, then run coolant lines all the way around the tap while staying entirely within the cold block. It is further not generally known to actually place a wide range of beverage taps into a cold block having coolant lines running all the way around tap within a temperature control block. It is further not generally known to actually place a portion control mechanism within a temperature control block.

Significantly, it is NOT known to provide a coolant chamber around the tap mechanism and within a temperature control block, thus providing highly stable temperatures right to very verge of dispensing of beverages such as milk, coffee, beer, or the like.

It would be desirable to provide a device which allows beverages to be maintained at a desirable determined temperature including when the beverage is within the actual tap itself, by placing the taps within the cold block.

SUMMARY OF THE INVENTION

General Summary

The present invention teaches a beverage tower of the type having a cold block, or more broadly a temperature control block, with coolant recirculation, and further in which the stout-style of tap does not project from the block but rather is actually built into the cold block and fused into the block permanently and without any cavities, so as to keep the entire beverage tap body cold. This unitary and integrated tap-embedded cold block presents a number of advantages over known prior art, most especially, the ability to maintain dairy products at a consistently safe temperature which meets regulatory approval.

Traditional systems, which tend to be useful strictly for beer technology, have one end of the tap or the valve seat of the tap located just beyond (exterior to) a cold block. By contrast, the present invention teaches that the entire stout tap or other similar tap (with the exception of parts such as a handle or a self-draining nozzle orifice) may be located within the cold block and is thus useful for many diverse beverages. In the present invention, the mounting potions of the stout tap are removed from the tap and thus, a vertical body tap is created. This vertical body tap can then be placed into a horizontally oriented cold block and may pass therethrough, thus being operational, serviceable, cleanable, removable and yet integrated into the cold block with its outer parts actually fused therein and its valve stem assembly entirely surrounded by both cold block and coolant lines. Beverages like milk passing through the cold block thus are maintained consistently cold while waiting in the block.

To further increase the effectiveness of the design, not only are there coolant channels which wind in serpentine fashion about the beverage channels and the tap itself, but there may also be provided a coolant chamber. The coolant chamber may have the stout tap sealed within the coolant chamber and the coolant chamber may then itself be embedded within the cold block. It is axiomatic that the coolant lines and coolant chamber are hydraulically separated in all ways and at all points from the beverage channels.

The glycol lines within the cold block may optionally be arranged so as to pass entirely around the stout tap in the cold block, even around the entire tap, with a 360 degree envelopment on all sides. This results in the tap remaining cooled so long as the glycol recirculation system keeps the block in which it is embedded and fused cold. (With the addition of a coolant chamber not only is 360 degree envelopment provided but in addition, a larger heat rejection capability is provided as well: the coolant mass in proximity to the tap valve is greater and thus provides faster cooling.) This design does not sacrifice the temperature stability provided by the cold block, either, as the coolant itself is maintained in a cold condition by the thermal mass of the cold block.

Serpentine beverage supply channels (and of course glycol channels as well) may be employed so that the beverage passing through the beverage supply channels has a longer run and longer time in contact with the cooled conductive material of the cold block, though the invention is about the location of the stout tap and the ability to better maintain already cool beverages. This provides more time and contact opportunity to reject heat from the beverage to the block and assist in maintaining sanitary conditions for the beverage.

Heat rejected from the beverage into the coolant chamber is then rejected into the coolant within the chamber (or further rejected into the cold block) is then of course moved in the moving coolant or rejected again into the glycol in the glycol channels (which are entirely sealed from the beverage channels) and carried away by a glycol recirculation pump back to the glycol storage bath within the glycol refrigeration unit.

Tested versions (specifically including the versions with coolant lines passing about the tap) with straight beverage supply lines passing through the block to a tap entirely within the cold block have passed NSF 20.

In addition, automated portion control may be achieved by embedding within not only the tap/valve but also the operating end (plunger end) of a solenoid, such as an electrical solenoid, or more realistically a gas operated solenoid, but any type may be employed.

Further in addition, the design may be used in multiple-tap beverage towers.

Finally, the present design may be used with a heating fluid instead of a coolant, resulting in the "cold block" becoming a "hot block" and providing thermal momentum to maintain a steady and constant high temperature. It will be understood that the terms "cold" and "cold block" used herein may refer to heat and the cold block may function as a hot block. If the broader term "temperature control block" is used, however, it will be understood that the block, while novel due to its aspects and elements, includes the term "cold block" and for the detailed description and claims of the invention, the two terms may be used interchangeably.

Thus the entire range of beverage towers can be used with the present invention, traditional, hand-operated, automated, multiple-tap, towers otherwise cooled, decorative towers and so on.

SUMMARY IN REFERENCE TO CLAIMS

It is therefore another aspect, advantage, objective and embodiment of the invention, in addition to those discussed previously, to provide a method of producing a cold block for a beverage tower, the method comprising the steps of:

providing at least one stout tap body, the stout tap body lacking a stem, the stout tap body having an internal valve assembly and an exterior tap body;

connecting a beverage conduit to the stout tap body, the beverage conduit having a first end connected to the stout tap body and a second end distal therefrom;

providing a mold for casting of the cold block, the mold having a plurality of walls defining at least a top, bottom, and rear;

positioning the stout tap body with connected beverage conduit within the mold, with the second end of the beverage conduit projecting to one wall of the mold, and further with the stout tap body projecting from the top and bottom of the mold, and further with the internal valve assembly and exterior tap body of the stout tap body within the mold;

positioning within the mold at least one glycol coolant line having first and second ends, the glycol coolant line being positioned within the mold with the first and second ends projecting to at least one wall of the mold, casting molten metal into the mold to entirely surround everything within the mold, whereby the exterior tap body of the stout tap body, the beverage line, and the coolant line are embedded integrally into the molten metal;

cooling the molten metal, whereby the cold block with unitary integral fused stout tap, coolant line and beverage line is formed with no cavities;

attaching at any time in the production a tap nozzle to the stout tap body where it projects from the bottom of the cold block;

attaching at any time in the production a tap handle to the stout tap body where it projects from the top of the cold block.

It is therefore another aspect, advantage, objective and embodiment of the invention, in addition to those discussed previously, to provide a method of producing a cold block further comprising:

positioning the glycol coolant line within the mold in contact with the exterior tap body of the stout tap body.

It is therefore another aspect, advantage, objective and embodiment of the invention, in addition to those discussed previously, to provide a method of producing a cold block further comprising:

positioning the glycol coolant line within the mold so as to pass entirely about the stout tap body, surrounding the stout tap body on all sides.

It is therefore another aspect, advantage, objective and embodiment of the invention, in addition to those discussed previously, to provide a method of producing a cold block producing a cold block of claim 3, further comprising:

removing the formed cold block with unitary integral fused stout tap, coolant line and beverage line from the tap;

trimming any flash from the the cold block;

covering the cold block with insulation gum.

It is therefore another aspect, advantage, objective and embodiment of the invention, in addition to those discussed previously, to provide a method of producing a cold block wherein at least one wall of the mold further comprises: an aperture dimensioned and configured to allow at least one conduit to project from the mold into the aperture; and further wherein the steps including positioning of the conduit end so as to project to a wall of the mold further comprises positioning the conduit end so as to project from the mold into the aperture; whereby when the cold block is produced the conduit end projects from the formed cold block.

It is therefore another aspect, advantage, objective and embodiment of the invention, in addition to those discussed previously, to provide a method of producing a cold block wherein the molten metal further comprises a metal which includes one member selected from the group consisting of nickel, iron, copper, tin, bronze, beryllium, chromium, manganese, magnesium, cobalt, zinc, molybdenum, silver, tungsten, and alloys and combinations thereof.

It is therefore another aspect, advantage, objective and embodiment of the invention, in addition to those discussed previously, to provide a method of producing a cold block wherein the molten metal further comprises one member selected from the group consisting of: steel, stainless steel, kirksite, aluminum and combinations thereof.

It is therefore another aspect, advantage, objective and embodiment of the invention, in addition to those discussed previously, to provide a method of producing a cold block wherein the conduits further comprise: food grade stainless steel.

It is therefore another aspect, advantage, objective and embodiment of the invention, in addition to those discussed previously, to provide a method of producing a cold block wherein the step of connecting the beverage conduit to the stout tap body further comprises silver soldering the beverage conduit to the stout tap body.

It is therefore another aspect, advantage, objective and embodiment of the invention, in addition to those discussed previously, to provide a method of producing a cold block made by the process described.

It is therefore another aspect, advantage, objective and embodiment of the invention, in addition to those discussed previously, to provide a beverage dispensing device comprising:

a cold block having a body made of a heat conducting material, the cold block having no cavities therein, the cold block having a top and bottom;

at least one stout tap, the stout tap embedded within the cold block, the stout tap having a bottom end projecting from the bottom of the cold block, the stout tap having a top end projecting from the top of the cold block, the stout tap having an internal valve assembly, the internal valve assembly within an exterior tap body of the stout tap, the exterior tap body being permanently embedded within the cold block;

whereby the internal valve assembly is positioned within the cold block;

at least one beverage channel passing through the cold block to the at least one stout tap;

at least one coolant channel passing through the cold lock to the at least one stout tap and passing entirely about the exterior tap body within the cold block;

the beverage channel and coolant channel being permanently embedded within the cold block.

It is therefore another aspect, advantage, objective and embodiment of the invention, in addition to those discussed previously, to provide a beverage dispensing device wherein at least one of the beverage channel, and the coolant channel, is serpentine within the cold block.

It is therefore another aspect, advantage, objective and embodiment of the invention, in addition to those discussed previously, to provide a beverage dispensing device further comprising:

a beverage tower, the cold block disposed within the beverage tower.

It is therefore another aspect, advantage, objective and embodiment of the invention, in addition to those discussed previously, to provide a beverage dispensing device further comprising:

a second stout tap embedded within the cold block, the second stout tap having an internal valve assembly positioned within an exterior tap body permanently embedded within the cold block;

whereby the internal valve assembly is positioned within the cold block;

a second beverage channel passing through the cold block to the second stout tap;

the coolant channel passing through the cold block to the second stout tap and passing entirely about the second tap exterior tap body within the cold block.

It is therefore another aspect, advantage, objective and embodiment of the invention, in addition to those discussed previously, to provide a beverage dispensing device further comprising:

a glycol return allowing glycol in the cold block coolant channel to re-circulate to a glycol cooling and re-circulation unit.

It is therefore another aspect, advantage, objective and embodiment of the invention, in addition to those discussed previously, to provide a beverage dispensing device further comprising:

first and second beverage supplies.

It is therefore another aspect, advantage, objective and embodiment of the invention, in addition to those discussed previously, to provide a beverage dispensing device wherein the first and second beverage supplies further comprise containers having therein one member selected from the group consisting of: milk, non-dairy products, carbonated and non-carbonated beer, other alcoholic beverages, syrups, water, coffee and tea, fruit juice and combinations thereof.

It is therefore another aspect, advantage, objective and embodiment of the invention, in addition to those discussed previously, to provide a beverage dispensing device comprising:

a solid cold block having a body made of a heat conducting material, the cold block having no cavities therein, the solid cold block having a bottom, the solid cold block being generally a prism shape oriented horizontally;

at least one electrically actuated solenoid;

at least one tap having a tap valve having a portion for containing beverage, the tap valve and its beverage containing portion embedded within the cold block, the tap valve having a top and bottom and being oriented vertically within the cold block;

the tap having a tap nozzle connected to the tap valve and projecting out of the bottom of the cold block, the tap being mechanically engaged to the solenoid whereby the solenoid controls the operation of the tap, the portion of the solenoid mechanically engaged to the tap valve being embedded within the cold block;

at least one beverage channel passing through the cold block to the at least one tap valve beverage containing portions; and at least one coolant channel passing through the cold lock to the at least one tap and passing entirely about the tap valve within the cold block.

It is therefore another aspect, advantage, objective and embodiment of the invention, in addition to those discussed previously, to provide a beverage dispensing device wherein at least one of the beverage channel, and the coolant channel, is serpentine within the cold block.

BRIEF DESCRIPTION OF THE DRAWINGS

FIG. 12 is a cutaway side view of of a PRIOR ART Perlick sanitary type of tap body, showing beer held within the body and outside of the shank and thus outside of any cold block to which it might be attached.

FIG. 13 is a cutaway side view of of a PRIOR ART general type of tap body, showing beer held within the body and outside of the shank.

FIG. 14 is a cutaway side view of a PRIOR ART stout type tap, such as might be used in the present invention, however, with un-necessary portions still attached.

FIG. 15 is a cutaway side view of a PRIOR ART European type tap.

FIG. 20 is a table of the steps of one embodiment of the method of the invention.

INDEX TO REFERENCE NUMERALS

Figure 1:
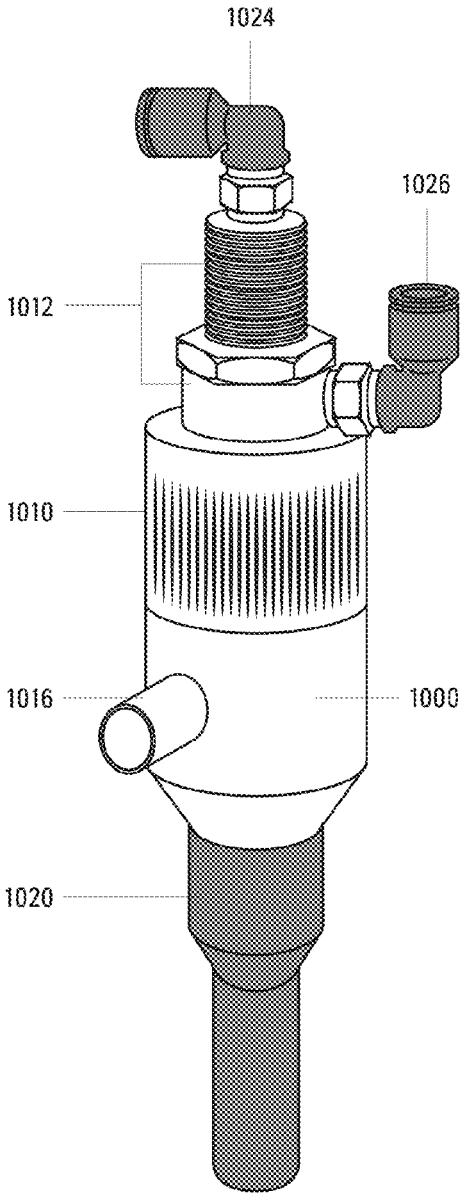
FIG. 1 is a perspective view of a gas solenoid controlled tap.

1 Sanitary tap lever
2 Sanitary tap point of dispense
3 Sanitary tap nozzle
4 Sanitary tap body
5 Sanitary tap valve stem
6 Shank
7 Shank coupling assembly
8 General beer tap point of dispense
9 General tap valve stem
10 General tap lever
11 General tap body
12 Stout tap lever
13 Stout tap coupling connector body
14 Stout tap body (exterior)
15 Stout tap body (interior)
16 Stout tap valve stem
17 Stout tap nozzle
18 Rototap lever
19 Rototap body
20 Rototap lever body
21 Rototap point of dispense
22 Rototap nozzle
23 Stout tap point of dispense
50 Cold block
51 Fused stainless steel glycol coolant line
52 Fused stainless steel glycol coolant lines touching tap body front and back
53 Tap handle
54 Tap lever
55 Tap lever assembly locking nut
56 Internal valve assembly
57 Exterior tap body
58 Fused exterior tap body—ghosted
59 Interior tap body
60 Tap body point of dispense
61 Tap body point of dispense w/seated valve stem assembly
62 Tap nozzle
63 Fused embedded tab body—no voids
64 Fused stainless steel beverage line
65 Exterior tap body threaded nut coupling
66 Fused tap body
102 Tower
104 Tower top
106 General tap
106A Perlick Sanitary Tap
106B Stout Tap
108 Valve Point of Dispense
110 Tap/Shank Coupling Nut
112 Tap Orifice (outlet)
114 Tap Handle
116 Embedded Shank Assembly
120 Cold Block
122 Cold Block Insulating Foam
124 Embedded Shank Socket (optional)
126 Beverage Cooling Channel
1000 tap body
1002 coolant chamber (interior)
1004 tap body exterior (coolant chamber)
1005 coolant chamber body (exterior)
1006 coolant chamber inlet/outlet
1008 coolant chamber inlet/outlet
1010 tap cap (top)
1012 tap portion control solenoid
1014 tap solenoid valve plunger
1016 tap beverage inlet
1018 tap beverage outlet
1020 tap outlet nozzle
1022 tap valve O-rings
1024 solenoid gas outlet
1026 solenoid gas inlet
1030 cold block
1050 coolant feed line
1052 upper coolant channel
1054 lower coolant channel
1056 coolant return line
1058 coolant channel bridge
1060 beverage feed line
1062 beverage cooling channel
1070 chambered tap
2000 Mold
2002 Interior of mold
2004 Top of mold (optional)
2006 Rear wall of mold
2008 Conduit end aperture
2010 Alignment device (for example, aperture for stout tap, indicia for conduits, etc)
3000 Provide stout tap
3002 Provide beverage conduit
3004 Attach beverage conduit to stout tap (silver solder)
3006 Provide mold

3008 Position stout tap and beverage conduit in mold, stout tap projecting from top (if non-electric) and bottom (nozzle), conduit ends projecting from mold

3010 Position coolant line (contact or surround valve body of stout tap)

3012 Cast molten metal into mold, leave no voids

3014 Cool molten metal, fusing cold block with conduits and tap

3016 Attach a tap nozzle to stout tap bottom end

3018 Attach a tap handle to stout tap top (if non-electric)

3020 Remove from mold

3022 Clean, trim

3024 Apply adhesive insulation such as insulation gum

DETAILED DESCRIPTION

FIG. 12 is a cutaway side view of of a PRIOR ART Perlick sanitary type of tap body, showing beer held within the body and outside of the shank and thus outside of any cold block to which it might be attached. Sanitary-style tap lever 1 controls the operation of the device from above, however, it will be seen that the sanitary-style tap point of dispense 2 is quite near to sanitary-style tap's tap nozzle 3, and that the tap body 4 and sanitary tap valve stem 5 may contain within them a quantity of beverage.

If the PRIOR ART tap shown were to be embedded in the fashion of the Cleleand reference (see "Background" section), this quantity of beverage would be projecting from the front of the cold block and would warm up, causing the unit to fail an NSF test. In point of fact, applicant has tested this and confirmed the deficiency.

The Cleleand reference in fact is quite similar to this or to FIG. 13 is a cutaway side view of of a PRIOR ART general type of tap body, showing beer held within the body and outside of the shank 6. Shank coupling assembly 7 leads to the tap body 11, within which, again, a quantity of beverage may be seen. If the shank were to be embedded in a vertical cold block per Cleleand, it would look remarkably like the Cleleand FIG. 5 already referenced: the quantity of beverage would quickly warm and cause failure of sanitation testing.

The general-style beer tap point of dispense 8 is thus seen to be outside of the shank 6, however, in this case the point of dispense 8 is much closer than in FIG. 12, in which the point of dispense 2. Thus this system comes a bit closer to passing a test.

General tap valve stem 9 (not to be confused with beverage) may be seen, as well as the lever that controls it, tap lever 10.

Fairly obviously, if one tried to convert the Cleleand reference to work permanently embedded inside of a horizontally oriented cold block, tap would be impossible to remove or to clean and might not even function.

The same holds true for FIG. 15, which is a cutaway side view of a PRIOR ART European type tap, sold under the tradename Rototap.

Rototap lever 18 causes a portion of body 19, 20 to rotate relative to the rest of the body 19, 20, lining up an arcuate passage so beverage can flow to the nozzle 22. The point of dispense 21 is once again slightly outside of the shank, meaning that placed into a vertical cold block as taught by Cleleand, it would not be removable, cleanable or perhaps even operable.

In fact, the applicant has determined that the device of FIG. 14, a cutaway side view of a PRIOR ART stout type tap, might be used in the present invention, however, this view shows the tap with un-necessary portions still attached. In the process of production, these are removed, or simply never made in the first place.

In particular, stout tap coupling connector body 13 projects from the side and appears to present the same issues as the Perlick "Sanitary" type of tap. But once this is removed, the tap body is revealed to be a vertically oriented tap within the stout tap body exterior 14.

This vertical body, in accordance with the present invention, may be embedded and fused into a horizontally oriented cold block, with the stout tap lever 12 projecting from the top of the horizontally oriented cold block and the stout tap nozzle 17 projecting from the bottom of the cold block.

Stout tap body (exterior) 14 may take an overall cylindrical form, making it easy for the stout tap valve body to be removed, despite the exterior 14 being fused into the metal of the cold block. Stout tap body (interior) 15 has therein the vertically oriented stout tap valve stem 16. Stout tap nozzle 17 actually unscrews and screws on and thus further aids cleaning, even when the device is fused.

Stout tap point of dispense 23 may be seen to be well within the vertical body. Because of this, the beverage in the tap may be surrounded by a cold block and kept cold right to the point of dispense, unlike vertically oriented cold blocks with other types of taps sticking out of them.

This effective cooling is further aided by having the coolant lines passing all about the vertical tap body and thus all about the point of dispense and the stout tap valve shown, and the coolant lines may even contact the tap exterior 14. This will be seen in later figures, including FIG. 16.

Figure 16:
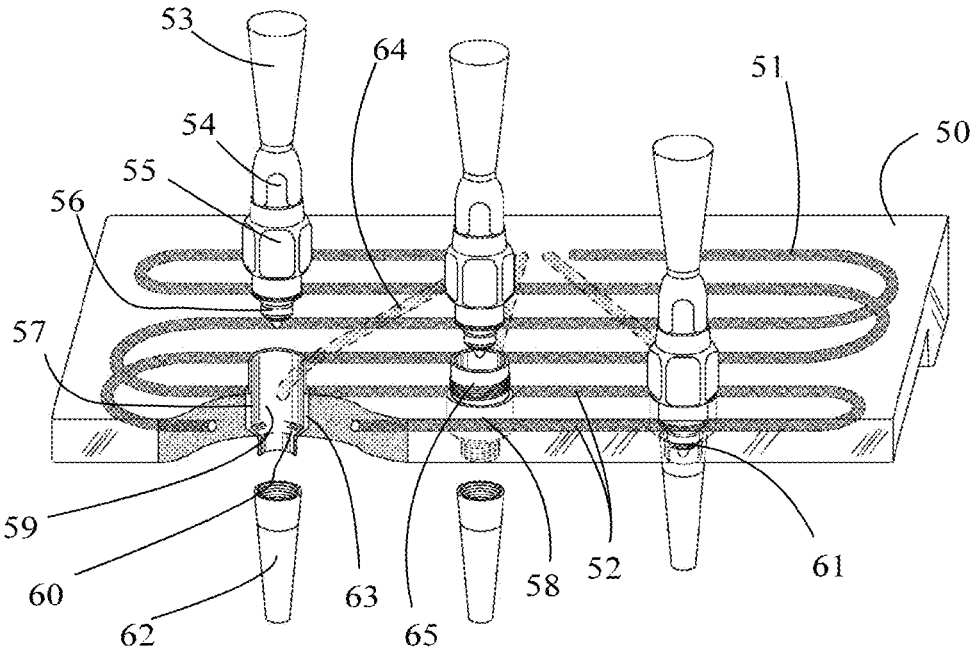
FIG. 16 is a partially cut-away, partially transparent, and also partially exploded oblique view of a cold block embodiment of the present invention having three stout taps embedded therein.
Figure 17:
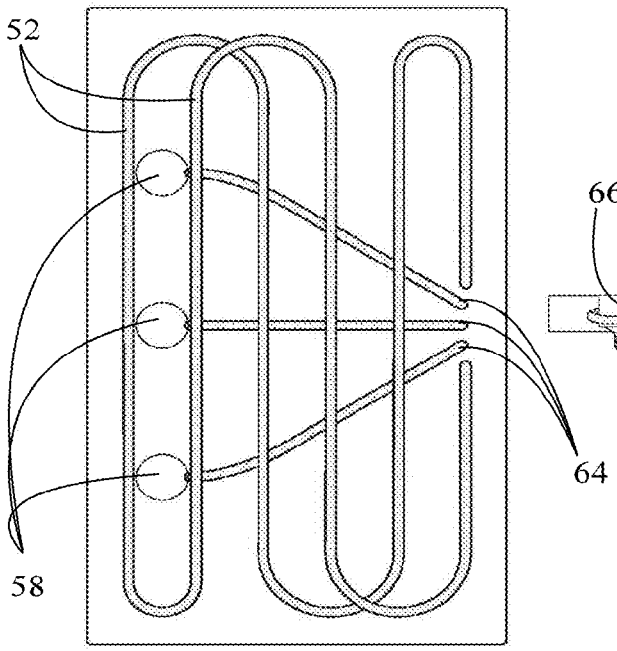
FIG. 17 is a planform view in transparency of a cold block of the embodiment of FIG. 16.
Figure 18:
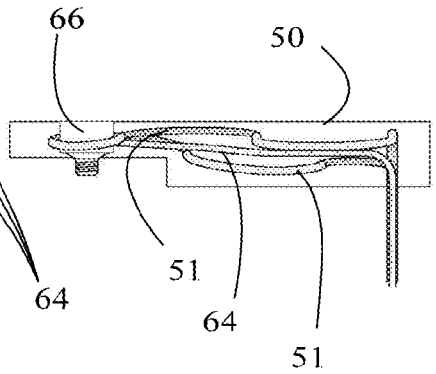
FIG. 18 is a partially transparent side view of a cold block of the invention.

FIG. 16 is a partially cut-away, partially transparent, and also partially exploded oblique view of a cold block embodiment of the present invention having three stout taps embedded therein, while FIG. 17 is a planform view in transparency of a cold block of the embodiment of FIG. 16 and FIG. 18 is a partially transparent side view of a cold block of the invention.

Cold block 50 has no voids, cavities or opening therein. That is, the molding process of producing the invention allows the device to be solid, unlike, for example, a bent metal soda fountain. The solid cold block 50 may be used within a hollow beverage tower, but it itself is solid. Note that components which are integral and fused into it may have void spaces: the conduits for coolant (fused stainless steel glycol coolant line 51) and beverage (fused stainless steel beverage line 64) allow liquid to pass therethrough, for example. The tap body internal valve assembly 56 allows beverages to pass when operated. However, tap body exterior 57 and the conduits fuse to the molten metal poured about them during production.

Fused stainless steel glycol coolant lines touching tap body front and back 52 may be seen to provide additional cooling capability (heat rejection). In addition, the fact that the coolant lines 51 pass all about the tap valve body 59 and internal valve assembly 56 within the tap body exterior 57 within the cold block 50 means that heat is rejected on all sides (horizontally) of the beverage within the cold block 50, right up to the point of dispense 60 which is also within the cold block 50 and surrounded on 4 sides by the coolant lines 51. This structural difference over the prior art is believed to be the reason the present invention passes sanitation tests when the prior art fails, which is a long-felt commercial need previously unmet.

Tap handle 53 actuates tap lever 54 within the tap lever assembly locking nut 55: note that removal of the locking nut allows removal of various parts of the tap and eventually, even removal of internal valve assembly 56 for cleaning or repair.

Fused exterior tap body (ghosted) 58 has within it the interior tap body 59, the efficiently cooled tap body point of dispense 60 and so on. The tap body point of dispense 61 is shown seated with the valve stem assembly in place for use and tap nozzle 62 attached where the tap valve assembly reaches the bottom side of the cold block. Fused embedded tap body 63 may be seen to have no voids about it. Exterior tap body threaded nut coupling 65 is another item used to allow removal of the internal valve assembly for cleaning despite the fact that the tap body 66 is entirely fused and surrounded on four sides by the cold block 50.

Figure 19:
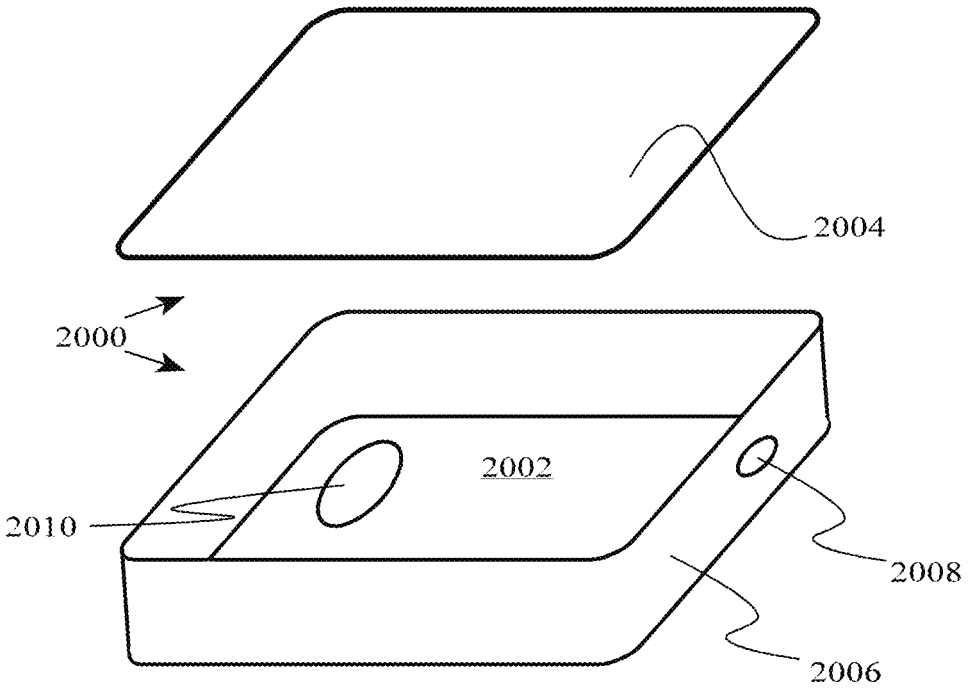
FIG. 19 is an oblique elevation view of an exemplary mold of the invention, greatly simplified.

FIG. 19 is an oblique elevation view of an exemplary mold of the invention, greatly simplified. This mold is depicted in a block diagram merely to show in the most general possible way the components of a mold as used for production of the item.

Mold 2000 has a mold interior 2002, as well as mold walls, such as the top 2004, the bottom (not numbered but visible), the rear wall 2006, sides walls, a front wall etc. While the mold is shown as if very thin construction, in reality is quite thick, while it is shown with no ancillary equipment in fact the ancillary equipment is many times larger than the mold and so on and so forth. Top of mold 2006 is optional.

Conduit end aperture 2008 allows a conduit end to protrude beyond the mold wall 2006 during production. Molten metal will not leak if it is sized exactly (aperture 2008 inner diameter equaling conduit outer diameter) and/or sealed properly.

Alignment device 2010 may be an aperture for a stout tap, indicia for conduits, etc but in any case it may serve a role as an aperture to allow a tap portion to protrude, as a guide for accurate placement and so on and so forth.

FIG. 20 is a table of the steps of one embodiment of the method of the invention. In a method embodiment of the invention, one potential first step is to provide a stout tap body, 3000, the stout tap body lacking a stem, the stout tap body having an internal valve assembly and an exterior tap body.

It is also necessary to provide a beverage conduit, step 3002, and step 3004, attach the beverage conduit to the stout tap by means of silver soldering, thus connecting a beverage conduit to the stout tap body. The beverage conduit has a first end connected to the stout tap body and a second end distal therefrom, the distal end will in due course reach a wall of the mold or even project from the mold or the finally formed cold block.

Step 3006, providing a mold, is necessary for casting of the cold block, the mold should have a plurality of walls defining at least a top, bottom, and rear, sides, front, etc. It may also have the aperture/apertures seen in the previous figure.

Step 3008 consists of positioning the stout tap and beverage conduit in the mold, with the stout tap projecting from the top (if non-electric and possibly even if it is a solenoid version) and the bottom too (the nozzle or portion of the body that connects to the nozzle), and with the conduit ends projecting from the mold or at least to one wall. The complete list of requirements is as follows: positioning the stout tap body with connected beverage conduit within the mold and with the second end of the beverage conduit projecting to (or through) one wall of the mold. Further positioning it with the stout tap body projecting from the top and bottom of the mold, and further yet with the internal valve assembly and exterior tap body of the stout tap body within the mold.

Step 3010 is to position within the mold the coolant line which should contact or surround valve body of stout tap, as discussed elsewhere and shown in the diagrams, and with the first and second ends projecting to at least one wall of the mold and preferably out of the mold, or in other ways arranging for the lines to project from the finished cold block.

Step 3012 is the crucial casting of molten metal into the mold, leaving no voids. Casting of the molten metal into the mold to entirely surround everything within the mold, results in the exterior tap body of the stout tap body, the beverage line, and the coolant line becoming fused as they are embedded integrally into the molten metal.

The preferred embodiments and best mode now contemplated make use of steel, stainless steel, kirksite, aluminum and alloys thereof for the cold block. However, in alternative embodiments nickel, iron, copper, tin, bronze, beryllium, chromium, manganese, magnesium, cobalt, zinc, molybdenum, silver, tungsten, and similar materials may be used. Obviously, alloys of these materials, even aluminum alloys now known or later discovered, may be used.

Cooling the molten metal forms the cold block with unitary integral fused stout tap, coolant line and beverage line with no cavities. (Step 3014).

Steps 3016 and 3018 may be carried out at any time: attachment of the tap nozzle to the stout tap bottom and the handle to the top.

Step 3020 is removal from the mold after which the integrated, fused, unitary solid cold block may be cleaned and trimmed of flash.

An application of insulation, such as insulation gum or other adhesive insulation is then possible. This will prevent the cold block from sweating when it is cooled.

Figure 2:
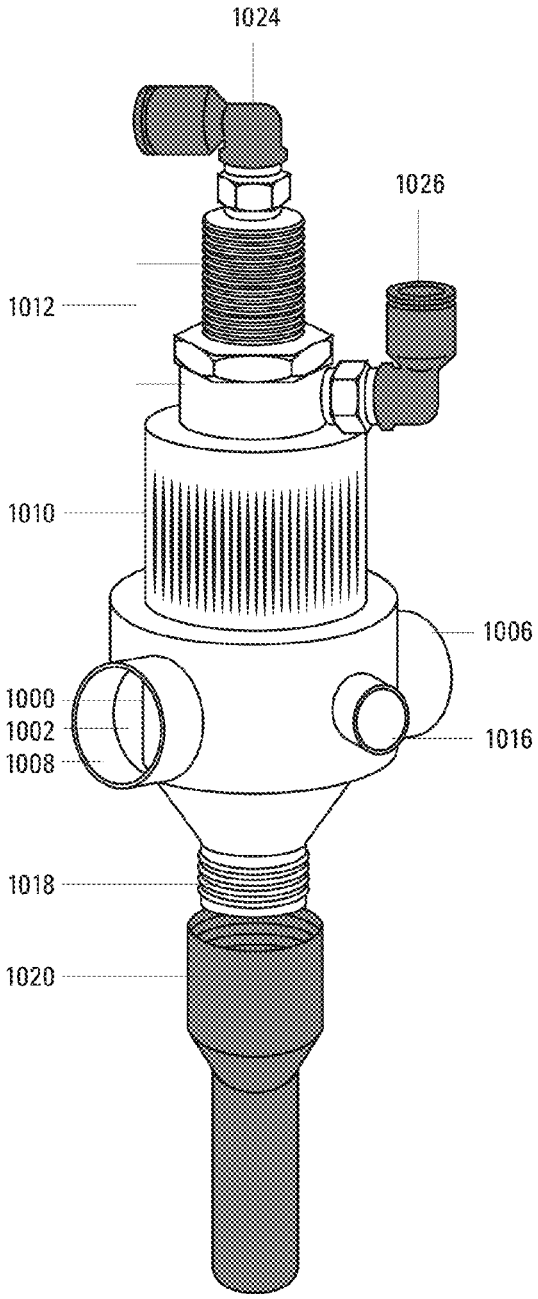
FIG. 2 is a perspective view of a second embodiment of the invention, a gas solenoid controlled tap within a coolant chamber.

FIG. 1 is a perspective view of a gas solenoid controlled tap having a tap, a solenoid, gas inlets and so on. (This simple alternative embodiment of the invention may be distinguished by the fact that it lacks the coolant chamber which is the preferred embodiment, and which is shown in FIG. 2 et seq.) In FIG. 1, tap body 1000 is shown without the cold block within which it is embedded, the cold block is shown in later figures. Tap body 1000 has a tap cap 1010, as well as tap portion control solenoid 1012. Beverage inlet 1016 is obviously provided to allow entry of beverages into the tap, within which they will pass the solenoid plunger, the outlet and finally exit from the tap body 1000 by way of tap outlet nozzle 1020. Tap portion control solenoid 1012 has a gas outlet 1024 and a gas inlet 1026. In operation, the gas flowing through these ports 1024/1026 (and through the lines connected thereto) controls operation of the tap solenoid 1012 and thus controls operation of the tap and the portion controlled dispensing of beverages.

While FIG. 1 depicts an entirely separable embodiment of the invention requiring no additional aspects, advantages and elements of the invention to work when embedded in a cold block with coolant lines thereabout, it may in fact advantageously considered to be the core of the preferred embodiment of the invention depicted in FIG. 2, and for this reason shares numbering therewith.

FIG. 2 is a perspective view of a second embodiment of the invention, a gas solenoid controlled tap within a coolant chamber. In the presently preferred embodiment and best mode presently contemplated for carrying out the invention, the gas solenoid portion controlled tap is within the coolant chamber of the invention. Tap body 1000 is slightly visible in the coolant chamber interior 1002 though the aperture of coolant chamber outlet 1008, the larger port thereon. Coolant chamber outlet 1006 is partially visible on the distal side of the device. In operation, either of coolant chamber outlets 1006/1008 may in fact function as a coolant inlet, the term outlet is used generically in this case. Tap beverage inlet 1016 is shown at a 90 degree angle from the first embodiment: it may be oriented in any convenient direction or may connect internally within the chamber 1002. Finally, tap outlet nozzle 1020 is shown disengaged from but proximal to and oriented with tap beverage outlet 1018, so as to show the relationship therebetween: the tap outlet nozzle 1020 may physically engage, either directly as shown or indirectly with intervening parts to tap beverage outlet 1018. In this preferred embodiment the engagement is threading, allowing easy disassembly and cleaning, but other methods may be employed in alternative embodiments. Note that such disassembly and cleaning, at least in part, may well be, depending upon exact regulations, a legal necessity for at least parts of the tap of the invention.

Operation of the device in general terms may be partially understood with reference to FIG. 2. Solenoid 1012 has an internal plunger which controls beverage flow. Under normally closed conditions, solenoid 1012 blocks flow. Beverage is provided and available but not flowing into the tap body 1000 through tap beverage inlet port 1016. Meanwhile coolant may be found to be entering and leaving the coolant chamber interior 1002 by way of the two coolant chamber outlets 1006/1008 (continuously in the preferred embodiments, although the invention is not limited to this). Finally, the gas which controls the operation of the solenoid 1012 is pressurized or available to solenoid gas inlet 1026.

When beverage is to be dispensed, solenoid gas inlet 1026 alters the flow of gas so as to actuate solenoid 1012, which causes the flow of beverage to be enabled. Note that coolant flow through the coolant chamber (the interior) 1002 and beverage flow through tap beverage inlet 1016, the tab body 1000, past the solenoid plunger and out tap beverage outlet 1018 and tap outlet nozzle 1020 in fact may be entirely unrelated, may be related by automated temperature controls, or may be directly linked, so that actuation of one causes the flow of new coolant. In the presently preferred embodiment, the flow of coolant is dependent only upon temperature maintenance considerations and not upon flow of the beverage. As noted previously, the coolant and the beverage are entirely separate.

Figure 3:
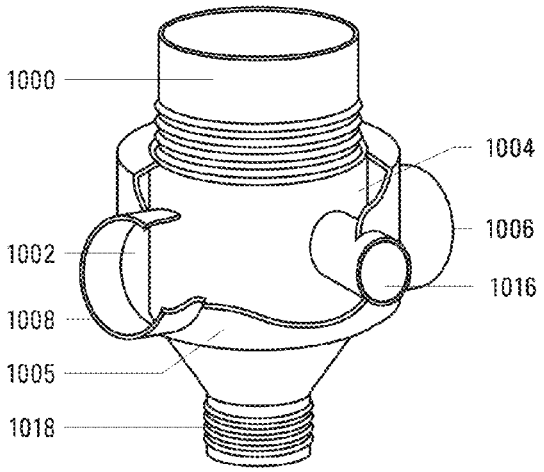
FIG. 3 is a partially cutaway perspective view of the coolant chamber of the second embodiment of the invention.

FIG. 3 is a partially cutaway perspective view of the coolant chamber of the second embodiment of the invention. The structural details of the coolant chamber may be better understood by reference to this diagram.

The tap body exterior 1004 of tap body 1000 of FIG. 3 is surrounded by the hollowed toroidal shape coolant chamber (interior) 1002 of this embodiment. Coolant is supplied and removed from coolant chamber outlets 1006/1008 and partially or wholly fills the coolant chamber interior 1002. In the preferred embodiments, the coolant chamber is largely or entirely filled.

The size and shape of the coolant chamber 1002 (interior) is obviously defined by the coolant chamber body (or exterior or wall) 1005, and this may be any shape chosen for cooling efficiency or the constraints of the beverage dispensing apparatus, such as size, shape and so on. It will be understood that the tap body 1000 is thus disposed within the coolant chamber 1002 while the coolant chamber body 1005 is in turn embedded within the cold block of aluminum or Kirksite or other suitable material. Note that any suitable material now known or later developed will fall within the scope of the appended claims. Beverage, as noted previously, enters through tap beverage inlet 1016 and exit through tap beverage outlet 1018.

Figure 4:
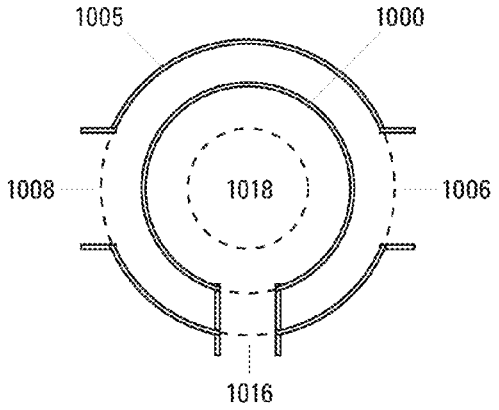
FIG. 4 is a partial and planform cross-sectional view of the second embodiment of the invention, showing the embedding of the solenoid controlled tap within the coolant chamber.

FIG. 4 is a partial and planform (top) cross-sectional view of the second embodiment of the invention, showing the embedding of the solenoid controlled tap within the coolant chamber. The tap solenoid valve plunger 1014 (FIG. 5) fits within the space defined by tap body 1000, while coolant flows within the toroidal (doughnut shaped) space (the coolant chamber 1002) defined by the tap body 1000 and the coolant chamber body exterior 1005. The penetration of tap beverage inlet 1016 through this space without allowing mixing with coolant may be seen as well. (Coolant of course might be a material harmful to human health, such as glycol. Other non-inimical coolants such as water or the like might still negatively impact taste of the dispensed beverage. Thus this aspect of the invention is very important).

Figure 5:
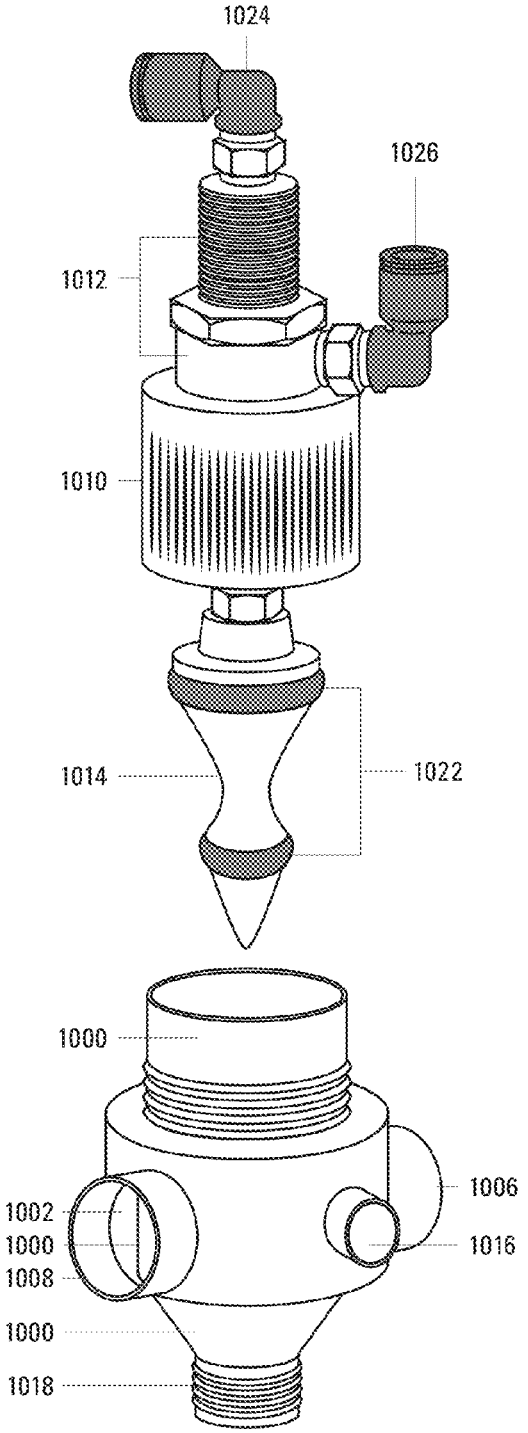
FIG. 5 is an exploded view of the second embodiment of the invention showing the gas solenoid controlled tap with the coolant chamber beneath it.

FIG. 5 is an exploded view of the second embodiment of the invention showing the gas solenoid controlled tap with the coolant chamber beneath it. This diagram provides a clear understanding of the use of tap solenoid valve plunger 1014. The tap solenoid valve plunger 1014 will normally have a plurality of positions within the tap body 1000. In a first position, the plunger, potentially by means of tap valve O-rings 1022 (as in this embodiment) or by similar seals, or by other means prevents flow of beverage. In the second position, the plunger moves, for example, in translation and upward, and thus allows flow. Obviously, the motion may be translation or rotation and may be in any direction and dimension within the scope of the invention, although the arrangement shown in FIG. 5 is regarded as most practical at the present time. Finally, it is potentially possible for the tap solenoid valve plunger 1014 to have yet a third or additional positions, for example, allowing different rates of flow, and yet be within the scope of the invention.

Figure 6:
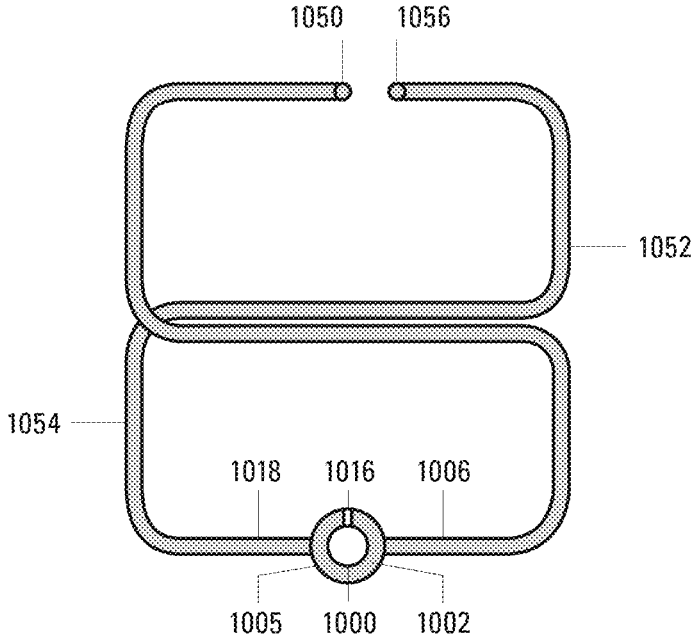
FIG. 6 is a planform or schematic view of the coolant channels of the invention showing the serpentine nature of the channels.

FIG. 6 is a planform or schematic view of the coolant channels of the invention showing the serpentine nature of the channels. Coolant feed line 1050 delivers coolant from a coolant system through lower coolant channel 1052 to coolant chamber outlet 1006, thus feeding cold coolant to the coolant chamber 1002. Coolant chamber outlet 1008 removes coolant from the chamber to lower coolant channel 1054 and thus coolant return line 1056. The tap beverage inlet 1016 may be seen to be separate from the coolant channels. The serpentine beverage channels may be seen in the next diagram.

Figure 7:
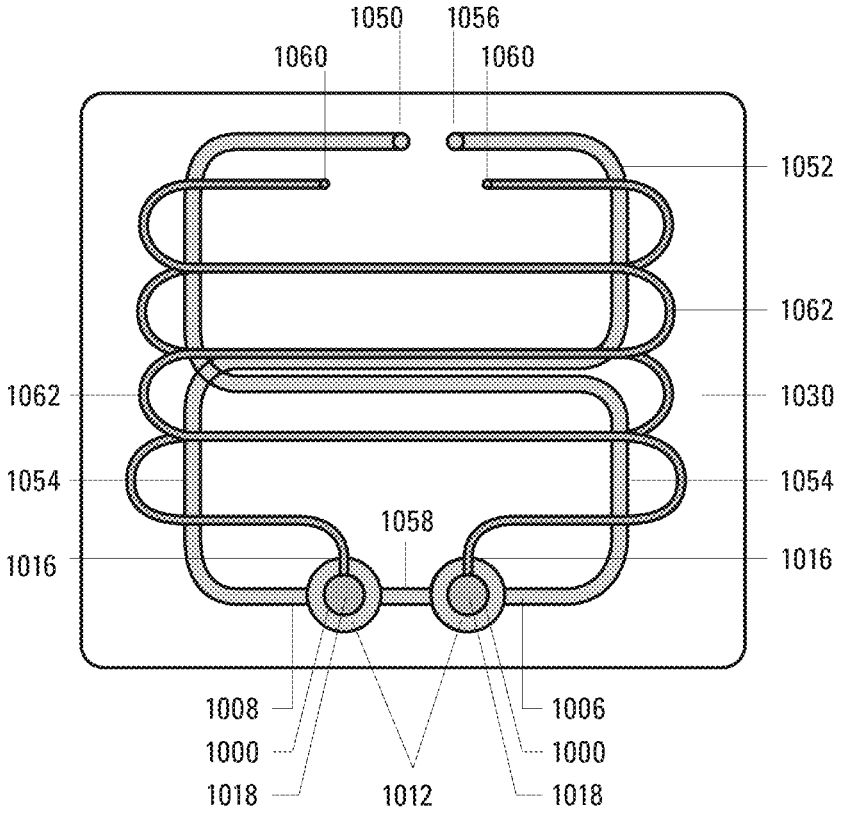
FIG. 7 is a planform cutaway view of the beverage channels and the coolant channels within a cold block embodiment of the invention.

FIG. 7 is a transparent planform or cutaway view of the beverage channels and the coolant channels within a cold block and two taps embodiment of the invention. In general, the overall configuration of the coolant channels is similar to that of the previously depicted single tap embodiment, however, in this embodiment there are two taps. Thus, coolant feed line 1050 again delivers coolant from a coolant system (not shown but present in the mother application, the entire disclosure of which has been incorporated by reference) through lower coolant channel 1052 to coolant chamber outlet 1006, thus feeding cold coolant to the dual coolant chambers. Coolant passes from one coolant chamber to another coolant chamber by means of coolant channel bridge 1058. Coolant chamber outlet 1008 removes coolant from the two chambers to lower coolant channel 1054 and thus coolant return line 1056. The tap beverage inlet 1016 may be seen to be separate from the coolant channels.

However, this figure also depicts the cold block 1030, in which the coolant lines and the beverage lines and the coolant chambers and the taps within the coolant chambers are all embedded. Beverage feed line 1060 provides a beverage to a tap, since there are two beverage feed lines, two different beverages may be supplied. The serpentine beverage feed line 1060 becomes beverage cooling channel 1062.

In operation, the beverage passes through the channels on the way to the tap, and in so doing rejects heat from the fluid of the beverage into the cold block 1030, which in turn rejects the heat into the coolant lines.

Figure 8:
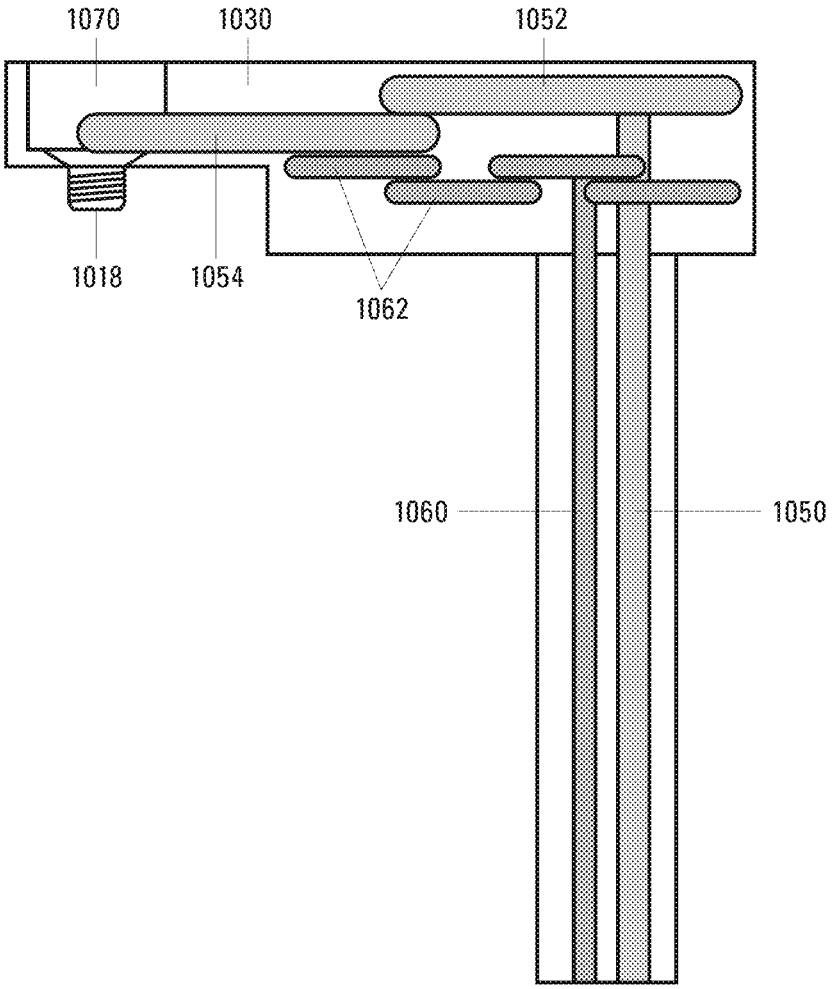
FIG. 8 is a cutaway side view of the beverage and coolant supplies, the coolant channels and the beverage channels of a cold block of the chambered embodiment of the invention.

FIG. 8 is a transparent or cutaway side view of the cold block, beverage and coolant supplies, the coolant channels and the beverage channels of a cold block of the invention. The cold block has a projecting top; the tap 1070 and chamber embedded within the cold block. Beverage lines 1062 may be seen within the cold block, below the coolant lines 1052. Tap beverage outlet 1018 may be seen to project slightly from the bottom of the block. The actuator (not shown), for example the solenoid for automatic portion control or a manual tap handle or other, may project from the top of the chamber/tap 1070.

Figure 9:
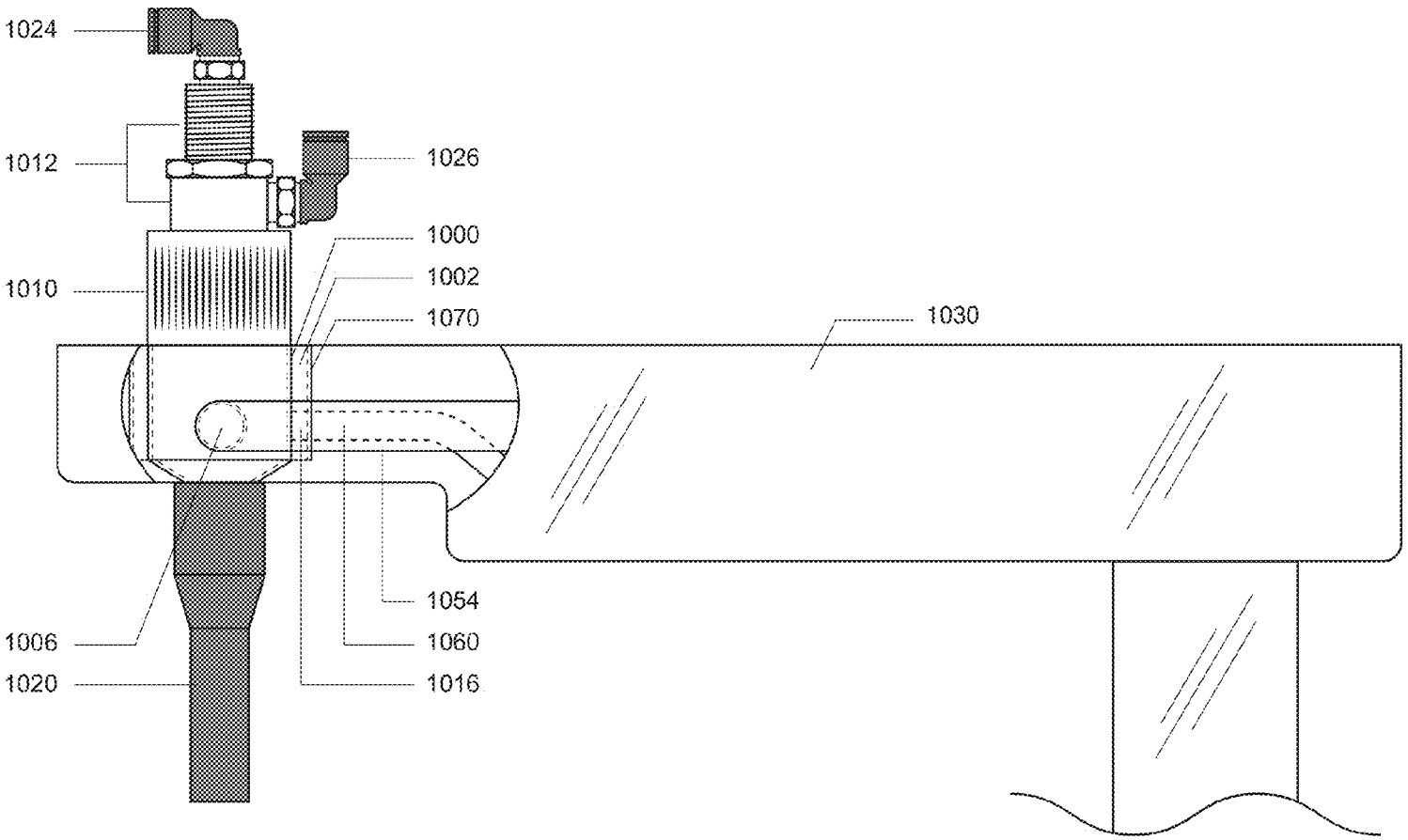
FIG. 9 is a partial side view with a sectional cutaway, showing the beverage control tap, the coolant chamber, and related structures.
Figure 11:
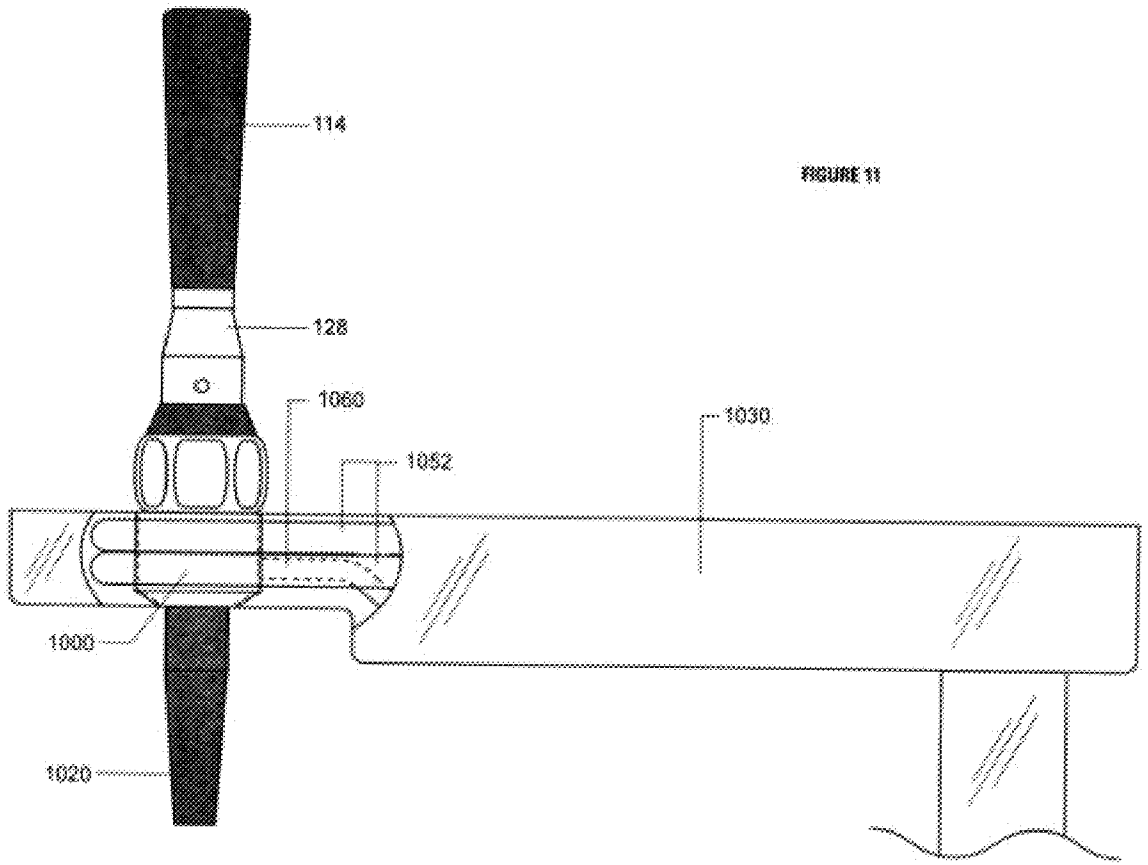
FIG. 11 is a partial side view with a sectional cutaway, showing the traditional manual tap and related structures within the present invention's earliest embodiments.

FIG. 9 is a partial side view with a sectional cutaway of the cold block, showing the beverage control tap, the coolant chamber, and related structures, while FIG. 11 is a partial side view with a sectional cold block cutaway, showing the traditional manual tap and related structures within the present invention. Arrangements are similar in both embodiments of the invention shown here. For the control portion & chambered tap, tap body 1000 is situated inside of coolant chamber 1002, itself within cold block 1030. Coolant chamber outlet 1006 and tap beverage inlet 1016 may be seen in transparency, while the various details of the solenoid are as previously described. Lower coolant channel 1054 and beverage feed line 1060 may also be seen providing coolant and beverage (respectively) to the chambered tap 1070. Obviously, the manual tap is similar but lacks the various solenoid aspects.

One important difference between these two embodiments is that the chamber (which may be present in either type) is used in one case and not in the other. In embodiments in which the chamber is used, the coolant surrounding the tap body provides a faster and more direct heat exchange. However, the embodiments with no chamber may be simpler to manufacture. Both embodiments are preferred at this time, although the chambered embodiment may well turn out to be "more preferred" in the light of experience.

The cold block shape need not be a simple prism, it can be any advantageous shape.

Figures 10A, 10B, 10C:
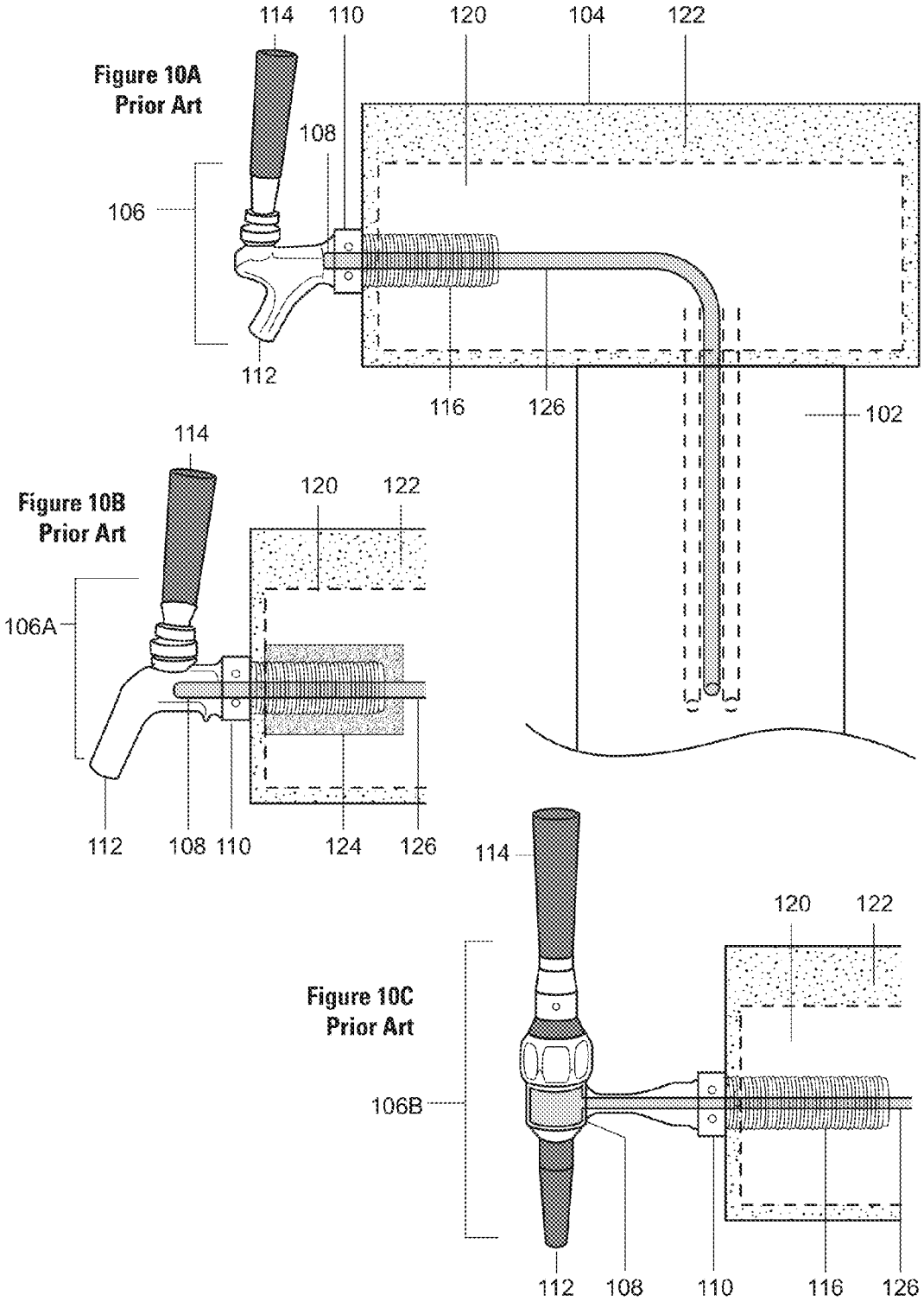
Figure 10A Prior Art
Figure 10B Prior Art
Figure 10C Prior Art
FIGS. 10A, 10B, 10C are views showing various PRIOR ART patents, most particularly, showing how various devices (such as the Perlick device and the devices of the prior art inventors referenced previously) do not in fact maintain cool beverage temperatures all the way to the final dispensing.

FIGS. 10A, 10B, 10C are views showing various prior art patents, most particularly, showing how various devices (such as the Perlick device and the devices of the prior art inventors referenced previously) do not in fact maintain cool beverage temperatures all the way to the final dispensing.

In typical scenarios for PRIOR ART, Tower 102 has external to Tower top 104 a tap. This tap may be one of various types. Depicted herein are three types: General tap 106, Perlick Sanitary Tap 106A, and Stout Tap 106B. These are taken from PRIOR ART referenced previously in the "Background" of this disclosure and discussed there in detail.

Significantly, Valve Point of Dispense 108 and the following Tap Orifice (outlet) 112 are well outside of Cold Block 120. Cold Block Insulating Foam 122 is used for further cooling, but of course does not compensate for the unhygienic fact that there is always some small amount of beverage outside of the cold block, warming and growing pathogens, because these designs do NOT embed the tap truly within the cold block. What is actually embedded is a shank assembly or Embedded Shank Socket (optional) 124 and most but not all of the length of the Beverage Cooling Channel 126.

The disclosure is provided to allow practice of the invention by those skilled in the art without undue experimentation, including the best mode presently contemplated and the presently preferred embodiment. Nothing in this disclosure is to be taken to limit the scope of the invention, which is susceptible to numerous alterations, equivalents and substitutions without departing from the scope and spirit of the invention. The scope of the invention is to be understood from the appended claims.

What is claimed is:

1. A beverage dispensing device comprising:

a cold block having a body made of a heat conducting material, the cold block having no cavities therein, the cold block having a top and bottom;

at least one stout tap, the stout tap embedded within the cold block, the stout tap having a bottom end projecting from the bottom of the cold block, the stout tap having a top end projecting from the top of the cold block, the stout tap having an internal valve assembly, the internal valve assembly within an exterior tap body of the stout tap, the exterior tap body being permanently embedded within the cold block;

whereby the internal valve assembly is positioned within the cold block;

at least one beverage channel passing through the cold block to the at least one stout tap;

at least one coolant channel passing through the cold lock to the at least one stout tap and passing entirely about the exterior tap body within the cold block;

the beverage channel and coolant channel being permanently embedded within the cold block.

2. The beverage dispensing device of claim 1, wherein at least one of the beverage channel, and the coolant channel, is serpentine within the cold block.

3. The beverage dispensing device of claim 2, further comprising:

a beverage tower, the cold block disposed within the beverage tower.

4. The beverage dispensing device of claim 3, further comprising:

a second stout tap embedded within the cold block, the second stout tap having an internal valve assembly positioned within an exterior tap body permanently embedded within the cold block;

whereby the internal valve assembly is positioned within the cold block;

a second beverage channel passing through the cold block to the second stout tap;

the coolant channel passing through the cold block to the second stout tap and passing entirely about the second tap exterior tap body within the cold block.

5. The beverage dispensing device of claim 4, further comprising:

a coolant return allowing coolant in the cold block coolant channel to re-circulate to a coolant cooling and re-circulation unit.

6. The beverage dispensing device of claim 5, further comprising:

first and second beverage supplies.

7. The beverage dispensing device of claim 6, wherein the first and second beverage supplies further comprise containers having therein one member selected from the group consisting of: milk, non-dairy products, carbonated and non-carbonated beer, other alcoholic beverages, syrups, water, coffee and tea, fruit juice and combinations thereof.

* * * * *